United States Patent [19]

Christ et al.

[11] 3,993,574

[45] Nov. 23, 1976

[54] BUILDER COMPOSITIONS

[75] Inventors: Thomas Christ, Belleville, Ill.; Robert P. Langguth, Overland, Mo.

[73] Assignee: Monsanto Company, St. Louis, Mo.

[22] Filed: Aug. 22, 1975

[21] Appl. No.: 606,901

[52] U.S. Cl. ..... 252/89 R; 252/527; 252/528; 252/546; 252/547; 252/DIG. 11

[51] Int. Cl.[2] ..... C11D 7/12; C11D 7/26; C11D 7/60

[58] Field of Search ..... 252/89, 523, 525, 527, 252/528, 544, 546, 547, DIG. 11, 541, 95, 102, 99

[56] References Cited

UNITED STATES PATENTS

| | | | |
|---|---|---|---|
| 3,775,348 | 11/1973 | Jakobi et al. | 252/524 |
| 3,865,755 | 2/1975 | Lannert | 252/558 |

*Primary Examiner*—Thomas J. Herbert, Jr.
*Assistant Examiner*—Bruce H. Hess
*Attorney, Agent, or Firm*—N. E. Willis; J. E. Maurer; H. B. Roberts

[57] ABSTRACT

Compositions comprising a mixture of from 60% to 95% by weight

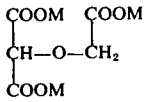

(M is alkali metal or ammonium) and, correspondingly, 5% to 40% by weight sodium carbonate function as a synergistic detergency builder.

2 Claims, No Drawings

BUILDER COMPOSITIONS

BACKGROUND OF THE INVENTION

The invention relates to novel detergency builder compositions.

Numerous materials are known which when employed in combination with various surfactants provide detergent formulations in which such materials function as adjuvants, reinforcers, supplements, augmentors, potentiators, and/or benefactors to provide enhanced cleaning performance. Such materials are generally referred to as detergency builders.

An effective recently-developed detergency builder is a compound represented by the formula

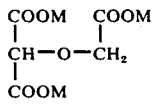

wherein M is alkali metal or ammonium. The use of this compound as a detergency builder is described in U.S. Pat. No. 3,865,755, the disclosure of said patent being incorporated herein by reference. As disclosed in said patent, the foregoing compound can be employed alone as the sole builder in detergent formulations or can be used in combination with other builders, including sodium carbonate.

SUMMARY OF THE INVENTION

The present invention is based on the discovery that mixtures of

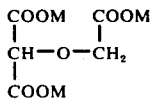

and sodium carbonate containing these ingredients in the percentages hereinafter specified, provide synergistic detergency builder compositions exhibiting builder functionality superior to that of either ingredient employed alone. This invention will be understood from the following description of the preferred embodiments.

DESCRIPTION OF THE PREFERRED EMBODIMENTS

The first essential ingredient of the builder compositions of this invention is a compound represented by the formula

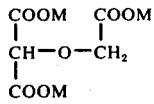

The use of the sodium salt form of this compound (M=Na) is particularly preferred. The ingredient will constitute from 60 – 95% by weight of the compositions of this invention.

The other essential ingredient of the compositions of this invention is sodium carbonate which will constitute from 5 – 40% by weight of the composition.

In order to provide the advantages of this invention, it is essential that the ingredients be employed in the amounts discussed above. If less than 5% sodium carbonate is employed, the performance of the resulting composition as a builder will not be substantially greater than that of

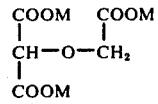

alone. If the percentage of sodium carbonate is greater than 40%, builder functionality as compared to compositions containing lesser amounts of sodium carbonate tends to decrease in various cleaning applications. The use of larger amounts of sodium carbonate tends to introduce certain deleterious effects (solids deposition, ash build-up, etc.) in various washing applications and may tend to render the formulation excessively caustic. In general, the use of compositions containing 5% to 20% sodium carbonate is preferred.

The compositions can be prepared by simple mixing of the ingredients. The ingredients can, if desired, be added separately or concurrently to the other ingredients of detergent formulations and need not be premixed.

As indicated, the above-described compositions are useful as builders in detergent formulations.

The detergent formulations will contain at least 1% by weight and preferably at least 5% by weight of the builder compositions of this invention. In order to obtain the maximum advantages of the builder compositions of this invention, the use of from 5% to 75% of these compositions is particularly preferred. The compositions of this invention can be the sole detergency builder in the formulation or the compositions can be utilized in combination with other detergency builders which may constitute from 0 to 95% by weight of the total builders in the formulation. By way of example, builders which can be employed in combination with the novel builder compounds of this invention include water soluble inorganic builder salts such as alkali metal polyphosphates, i.e., the tripolyphosphates and pyrophosphates; alkali metal borates, bicarbonates, silicates, water insoluble alumino silicates, e.g., as described in German Pat. No. 2,433,485, and water soluble organic builders including amino polycarboxylic acids and salts such as alkali metal nitrilotriacetates, cycloalkane polycarboxylic acids and salts, ether polycarboxylates, for example

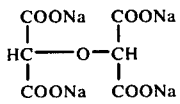

alkyl polycarboxylates, epoxy polycarboxylates, tetrahydrofuran polycarboxylates such as 1,2,3,4- or 2,2,5,5-tetrahydrofuran tetracarboxylates, benzene polycarboxylates, oxidized starches, amino(trimethylene phosphonic acid) and its salts, diphosphonic acids and salts (e.g., methylene diphosphonic acid; 1-hydroxy ethylidene diphosphonic acid) and the like.

The detergent formulations will generally contain from 5% to 95% by weight total builder (although greater or lesser quantities may be employed if desired)

which, as indicated above, may be solely the builder compositions of this invention or mixtures of such compositions with other builders. The total amount of builder employed will be dependent on the intended use of the detergent formulation, other ingredients of the formulation, pH conditions and the like. For example, general laundry powder formulations will usually contain 20% to 60% builder; liquid dishwashing formulations 10% to 15% builder; machine dishwashing formulations 60% to 90% builder. Optimum levels of builder content as well as optimum mixtures of builders of this invention with other builders for various uses can be determined by routine tests in accordance with conventional detergent formulation practice.

The detergent formulations will generally contain a water soluble detergent surfactant although the surfactant ingredient may be omitted from machine dishwashing formulations. Any water soluble anionic, nonionic, zwitterionic or amphoteric surfactant can be employed.

Examples of suitable anionic surfactants include soaps such as the salts of fatty acids containing about 9 to 20 carbon atoms, e.g., salts of fatty acids derived from coconut oil and tallow; alkyl benzene sulfonates — particularly linear alkyl benzene sulfonates in which the alkyl group contains from 10 to 16 carbon atoms; alcohol sulfates; ethoxylated alcohol sulfates; hydroxy alkyl sulfonates; alkenyl and alkyl sulfates and sulfonates; monoglyceride sulfates; acid condensates of fatty acid chlorides with hydroxy alkyl sulfonates and the like.

Examples of suitable nonionic surfactants include alkylene oxide (e.g., ethylene oxide), condensates of mono- and polyhydroxy alcohols, alkyl phenols, fatty acid amides, and fatty amines; amine oxides; sugar derivatives such as sucrose monopalmitate; long-chain tertiary phosphine oxides; dialkyl sulfoxides; fatty acid amides, (e.g., mono- or diethanol amides of fatty acids containing 10 to 18 carbon atoms), and the like.

Examples of suitable zwitterionic surfactants include derivatives of aliphatic quaternary ammonium compounds such as 3-(N,N-dimethyl-N-hexadecyl ammonio)propane-1-sulfonate and 3-(N,N-dimethyl-N-hexadecyl ammonio)-2-hydroxy propane-1-sulfonate.

Examples of suitable amphoteric surfactants include betaines, sulfobetaines and fatty acid imidazole carboxylates and sulfonates.

It will be understood that the above examples of surfactants are by no means comprehensive and that numerous other surfactants are known to those skilled in the art. It will be further understood that the choice and use of surfactants will be in accordance with well-understood practices of detergent formulation. For example, anionic surfactants, particularly linear alkyl benzene sulfonate, are preferred for use in general laundry formulations, whereas low foaming nonionic surfactants are preferred for use in machine dishwashing formulations.

The quantity of surfactant employed in the detergent formulations will depend on the surfactant chosen and the end use of the formulation. In general, the formulations will contain from 5% to 50% surfactant by weight, although as much as 95% or more surfactant may be employed if desired. For example, general laundry powder formulations normally contain 5% to 50%, preferably 15% to 25% surfactant; machine dishwashing formulations 0.5% to 5%; liquid dishwashing formulations 20% to 45%. The weight ratio of surfactant to builder will generally be in the range of from 1:12 to 2:1.

In addition to builder and surfactant components, detergent formulations may contain fillers such as sodium sulfate and minor amounts of bleaches, dyes, optical brighteners, soil anti-redeposition agents, perfumes and the like.

In machine dishwashing compositions the surfactant will be a low-foaming anionic or preferably nonionic surfactant which will constitute 0 to 5% of the formulation.

The term "low-foaming" surfactant connotes a surfactant which, in the foaming test described below, reduces the revolutions of the washer jet-spray arm during the wash and rinse cycles less than 15%, preferably less than 10%.

In the foaming test, 1.5 grams of surfactant are added to a 1969 Kitchen-Air Home Dishwasher, Model No. KOS-16, manufactured by Hobart Manufacturing Company, which is provided with means for counting revolutions of the washer jet-spray arm during wash and rinse cycles. The machine is operated using distilled water feed at a machine entrance temperature of 40° C. The number of revolutions of the jet-spray arm during the wash and rinse cycles is counted. The results are compared with those obtained by operation of the machine using no surfactant charge and the percentage decrease in the number of revolutions is determined.

The surfactant should, of course, be compatible with the chlorine containing component hereinafter discussed. Examples of suitable nonionic surfactants include ethoxylated alkyl phenols, ethoxylated alcohols (both mono- and dihydroxy alcohols), polyoxyalkylene glycols, aliphatic polyethers and the like. The widely commercially utilized condensates of polyoxypropylene glycols having molecular weights of from about 1400 to 2200 with ethylene oxide (the ethylene oxide constituting 5 to 35 weight percent of the condensate) are, for example, advantageously used in the machine dishwashing formulations of this invention.

Suitable low-foaming anionic surfactants include alkyl diphenyl ether sulfonates such as sodium dodecyl diphenyl ether disulfonates and alkyl naphthalene sulfonates.

Mixtures of suitable low-foaming surfactants can be utilized if desired.

In addition, machine dishwashing formulations will contain sufficient chlorine providing compound to provide 0.5% to 2% available chlorine. For example, the formulation may contain from 0.5% to 5%, preferably 1% to 3% of a chlorocyanurate or from 10% to 30% chlorinated trisodium phosphate. Suitable chlorocyanurates are sodium and potassium dichlorocyanurate; [(monotrichloro)tetra-(monopotassium dichloro)] penta-isocyanurate; (monotrichloro) (monopotassium dichloro) diisocyanurate.

Machine dishwashing compositions should additionally contain from 5% to 30% soluble sodium silicate having an $SiO_2$ to $Na_2O$ mole ratio of from 1:1 to 3.2:1, preferably about 2.4:1, to inhibit corrosion of metal parts of dishwashing machines and provide over-glaze protection to fine china.

Machine dishwashing compositions will generally contain at least 10%, preferably at least 20%, up to a maximum of about 90% total builders. The new builder compositions of this invention should constitute at least 5% of the weight of the machine dishwashing formulation.

The invention is further illustrated by the following example wherein all percentages are by weight unless otherwise indicated.

EXAMPLE I

Detergent formulations containing 30% by weight of a builder composition having the percentages of

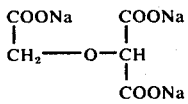

and sodium carbonate (based on the weight of these two ingredients) shown in Table 1 below, 18% linear alkylbenzene sulfonate having an average molecular weight of about 230; 12% sodium silicate; 1% carboxymethyl cellulose and 39% sodium sulfate are prepared. These formulations are individually tested by washing identically soiled swatches of cotton and polyester/cotton blend fabrics in wash water (150 ppm. hardness) containing 0.15% detergent formulation at temperatures of about 24° C. and 49° C. The difference in reflectivity of washed and unwashed samples is measured and shown in the table as ΔRd. Higher ΔRd values are indicative of superior cleaning performance with differences of 1.5 or more being considered significant.

Table 1

| Builder Composition % | % | Average Δ Rd on Washing | | | |
|---|---|---|---|---|---|
| COONa, COONa, CH—O—CH₂, COONa | $Na_2CO_3$ | Cotton at 49° C | Polyester/ Cotton at 49° C | Cotton at 24° C | Polyester/ Cotton at 24° C |
| 100 | 0 | 25 | 15 | 22 | 12 |
| 95 | 5 | 30 | 16 | 25 | 13 |
| 90 | 10 | 30 | 16 | 26 | 13 |
| 85 | 15 | 30 | 16 | 26 | 14 |
| 80 | 20 | 30 | 15 | 27 | 14 |
| 60 | 40 | 29 | 14 | 27 | 13 |
| 0 | 100 | 26 | 11 | 21 | 11 |

The data demonstrates the synergistic building activity of the builder compositions of this invention.

What is claimed is:

1. A builder composition consisting essentially of from 60% to 95% by weight of a compound represented by the formula

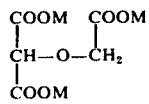

wherein M is alkali metal or ammonium and from 5% to 40% by weight sodium carbonate.

2. The composition of claim 1 wherein M is sodium.

* * * * *